US005899079A

United States Patent [19]

Dunnigan et al.

[11] Patent Number: 5,899,079

[45] Date of Patent: May 4, 1999

[54] DAMPER APPARATUS FOR REFRIGERATED VENDING MACHINES WITH A DEFROST CYCLE

[75] Inventors: David C. Dunnigan, Buffalo; Bart W. Baxter, Cottage Grove; Joseph A. Lotspeich, West St. Paul, all of Minn.

[73] Assignee: Gross-Given Manufacturing Company, St. Paul, Minn.

[21] Appl. No.: 08/835,759

[22] Filed: Apr. 10, 1997

[51] Int. Cl.[6] ..... F25D 21/00

[52] U.S. Cl. ..... 62/80; 62/276

[58] Field of Search ..... 62/255, 276, 277, 62/278, 80

[56] References Cited

U.S. PATENT DOCUMENTS

| | | | |
|---|---|---|---|
| 3,226,945 | 1/1966 | Spencer | 62/276 |
| 3,499,295 | 3/1970 | Brennan | 62/278 |
| 3,572,052 | 3/1971 | Toth | 62/278 |
| 4,569,206 | 2/1986 | Mitani et al. | 62/276 |
| 5,417,079 | 5/1995 | Rudick et al. | 62/255 |

*Primary Examiner*—William E. Tapolcai

*Attorney, Agent, or Firm*—Merchant, Gould, Smith, Edell, Welter & Schmidt, P.A.

[57] ABSTRACT

An apparatus and improved method for defrosting of the refrigeration unit of a refrigerated vending machine are disclosed. A damper controls flow of heated defrosting air in the refrigeration unit during a defrosting cycle to prevent the heated air from exiting out of the refrigerated air duct leading to the refrigerated compartment of the vending machine, thereby maintaining the desired ambient air temperature within the refrigerated compartment.

13 Claims, 6 Drawing Sheets

FIG.6
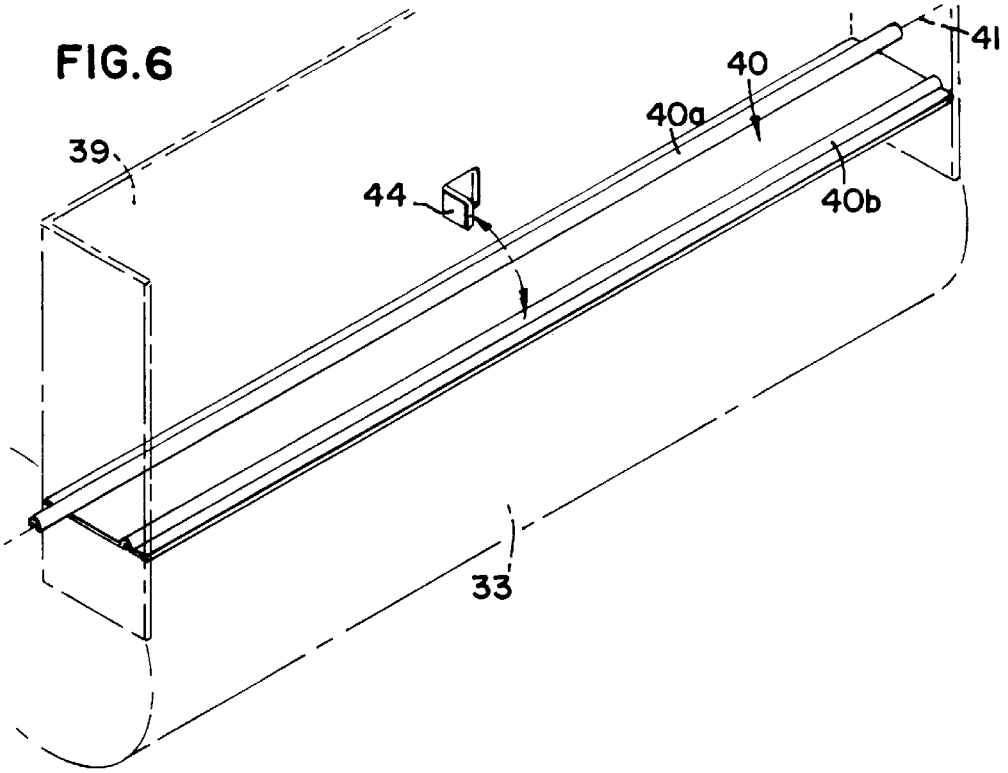
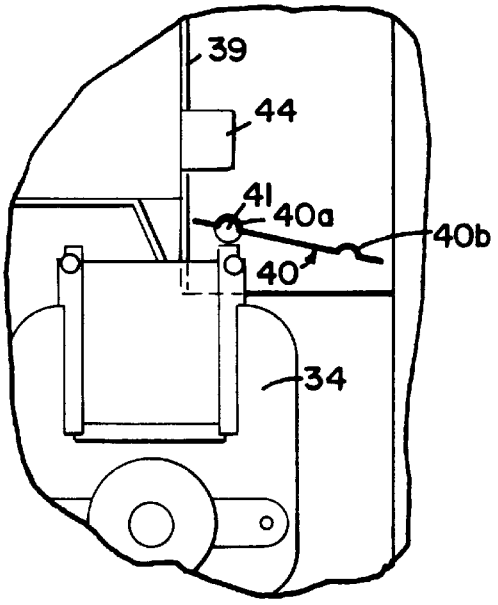
FIG. 7
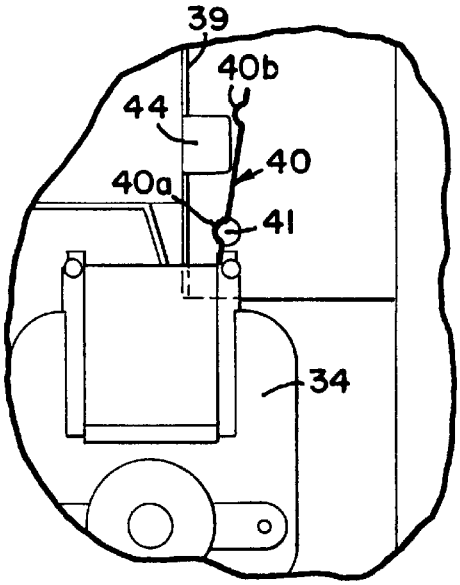
FIG. 8

DAMPER APPARATUS FOR REFRIGERATED VENDING MACHINES WITH A DEFROST CYCLE

FILED OF THE INVENTION

This invention relates generally to vending machines and more particularly to the regulation of air flow in refrigerated vending machines during a defrosting cycle.

BACKGROUND OF THE INVENTION

Vending machines of all types have become commonplace in today's societies. One of the more recent types of vending machines are those which dispense refrigerated, frozen or semi-frozen items. The refrigeration units of such vending machines are required to maintain the temperature of the refrigerated portion(s) of the vending machine at various temperatures depending upon the nature of the products being dispensed. For example canned or bottled beverages or cooled foods are typically maintained at temperatures of about 36° to 45° F. Semifrozen goods such as ice-cream are maintained at a temperature of about 9° F.; whereas frozen goods require refrigeration temperatures below −5° F. At such lower temperatures, condensation and eventually ice has a tendency to rapidly form on the evaporator coils of the machine's refrigeration unit, requiring frequent, routine defrosting of the evaporator coils. It is important to minimize the defrosting cycle time and to maintain the temperature of the refrigerated compartments during the defrosting cycle to prevent thawing or spoiling of the items stored therein. The refrigerated chamber(s) gain temperature during a defrosting cycle through normal heat gain through the chamber walls, through leakage through any seals associated with the chamber(s) and through any vending activities during the defrosting cycle. Further, the mechanics of the defrosting operation itself have been one of the largest contributors of heat gain to the refrigerated compartment(s) during a defrosting cycle.

The defrosting operation is typically accomplished by applying heat to the iced evaporator coils. In prior art refrigeration configurations, a significant amount of the applied defrosting heat has escaped through the airflow ducts associated with the evaporator coils, from the refrigeration unit and into the refrigerated compartment. Such escaping heat not only increases the defrosting time by requiring the application of yet more heat to the evaporator coils, but also directly increases the ambient air temperature of the refrigerated compartment(s). With prior art defrosting systems, the temperature within a refrigerated compartment housing frozen food could rise as high as an unacceptable 40° F. during a defrosting cycle and for a beverage or food containing compartment, as high as 60° to 70° F. The present invention addresses the above-described shortcomings and problems associated with the defrosting of prior art refrigerated vending machines.

SUMMARY OF THE INVENTION

This invention provides an apparatus and method for enhancing the defrosting operation in refrigerated vending machines which decreases the defrosting cycle time while minimizing heat transfer from the refrigeration unit to the refrigerated compartment during the defrosting cycle. According to one aspect of the invention there is provided a vending machine apparatus comprising:

(a) a chassis defining a refrigerated chamber for housing items to be dispensed and a second chamber separated from the refrigerated chamber by a divider wall;

(b) a refrigeration unit having an outlet port for supplying refrigerated air to the outlet port;

(c) air duct means operatively connected to the outlet port of the refrigeration unit and through the divider wall for supplying the refrigerated air to the refrigerated chamber;

(d) defrosting means operatively connected with the refrigeration unit for defrosting the refrigeration unit; and (e) air flow valve means for selectively controlling flow of air through the outlet port during defrosting of the refrigeration unit. According to a further aspect of the invention the air flow valve means comprises a damper that is operatively connected in the air duct means.

According to yet a further aspect of the invention there is provided an air flow control apparatus for use in combination with a refrigerated vending machine of the type having a refrigerated chamber for housing items to be dispensed, a refrigeration unit for supplying cold air, duct means operatively connecting the refrigeration unit to the refrigerated chamber and defrosting means for defrosting a portion of the refrigeration unit, comprising air flow control means operatively connected with the duct means for selectively controlling air flow through the duct means during a defrosting operation. According to yet a further aspect of the invention there is provided a method of defrosting a refrigeration unit of a refrigerated vending machine of the type having a refrigerated chamber for housing products to be dispensed, a refrigeration unit, defrosting means for the refrigeration unit, and air transfer duct means for delivering refrigerated air from the refrigeration unit to the refrigerated chamber, comprising the steps of:

(a) disabling any blowers or fans of the evaporator portion of the refrigeration unit during a defrosting cycle;

(b) applying defrosting heat to that portion of the refrigeration unit to be defrosted;

(c) preventing the applied defrosting heat from passing through the refrigeration unit air transfer duct and into the refrigeration chamber, thereby minimizing rise of ambient air temperature in the refrigerated chamber during the defrosting cycle.

According to any further aspect of the invention, such method includes maintaining the ambient air temperature within the refrigerated compartment of the vending machine below 51° F. during the defrosting cycle for a vending machine that is operatively configured to normally maintain ambient air temperature within the refrigerated compartment in the range of from about 37° F. to 45° F. According to yet another aspect of the invention, the method includes maintaining the ambient air temperature in the refrigerated chamber during the defrosting cycle to a temperature below 30° F. for a refrigerated vending machine that is operatively configured to normally maintain the ambient air temperature within the refrigerated compartment below about —5° F.

BRIEF DESCRIPTION OF THE DRAWINGS

FIG. 6. is an enlarged diagrammatic perspective view illustrating the damper assembly portion of the invention shown in FIG. 5;

FIG. 7 is an enlarged side view of the damper assembly portion of the invention shown in FIG. 4, illustrating the damper in a closed position; and FIG. 8 is an enlarged side view of the damper assembly portion of the invention shown in FIG. 4, illustrating the damper in an open position.

DETAILED DESCRIPTION OF THE PREFERRED EMBODIMENT

Figure 1:
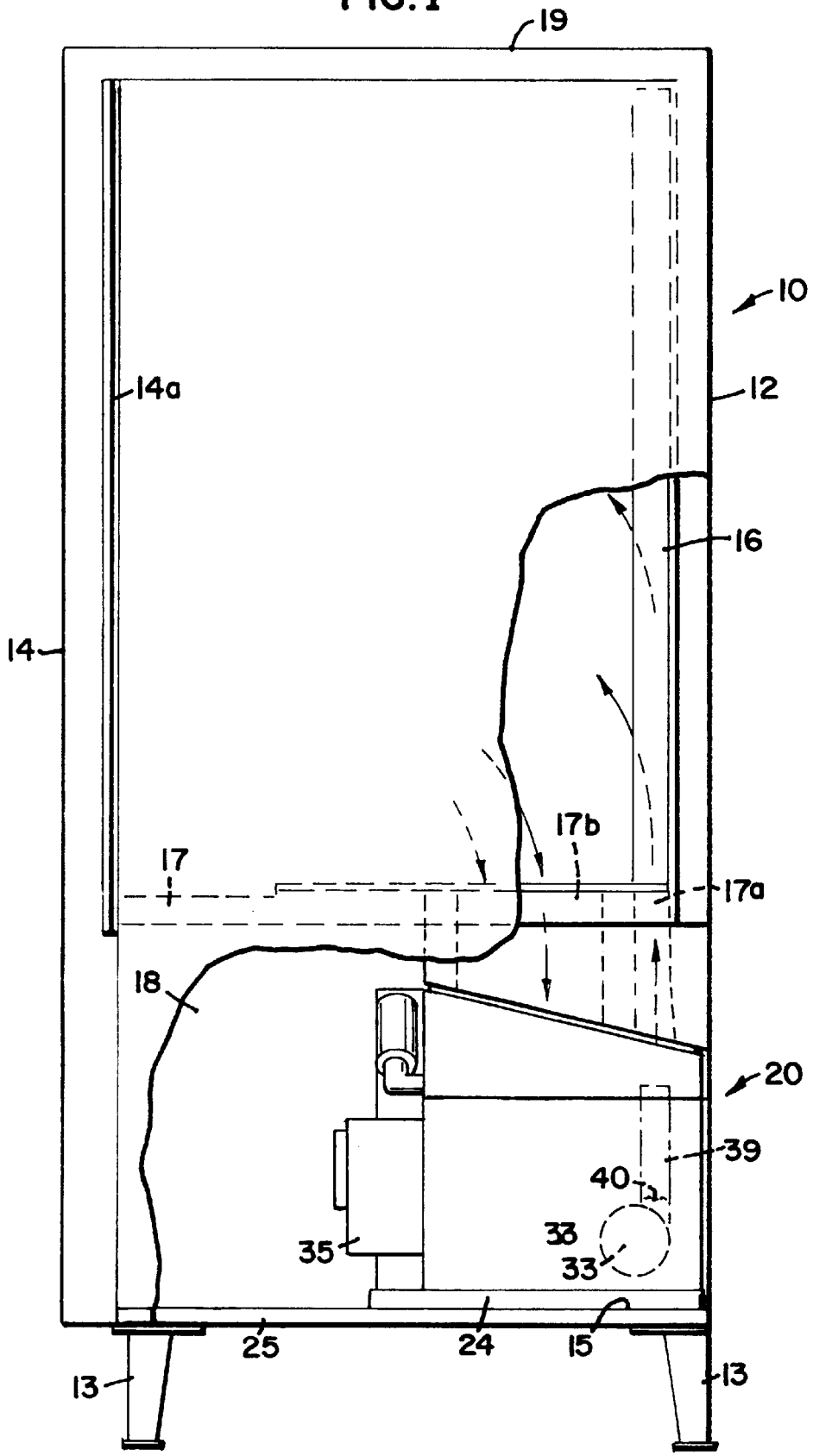
FIG. 1 is a view in side elevation, with portions thereof broken away, illustrating a vending machine of a preferred embodiment of the invention.

Referring to the Drawing, where unlike numerals represent like parts throughout the several views, a vending machine incorporating the principles of this invention is illustrated at 10 in FIG. 1. The vending machine 10 is a refrigerated type of machine designed for dispensing prepackaged food, beverage or other products that require refrigeration and/or freezing. The general nature and characteristics of such refrigerated vending machines are well-known in the art and will not be detailed herein except for the extent necessary for an understanding of the present invention.

Vending machine 10 generally includes a chassis 12 which encloses the top, bottom, back and opposed sides of the machine, and a front door assembly 14 that is pivotally mounted to the chassis 12. The chassis 12 may be supported in elevated manner upon a support surface by appropriate legs such as illustrated at 13 in FIG. 1. The door assembly 14 is normally locked in a closed position, as illustrated in FIG. 1 and defines with the chassis 12 one or more internal cavities of the vending machine. The front door assembly may include a multiple pane glass panel, illustrated at 14*a* which can be closed to selectively seal the upper compartment of the machine from exposure to the outside environment. Product selection, currency accepting and change providing mechanisms (not illustrated) are generally mounted within or on the front door assembly 14 for providing customer selection of products housed by the vending machine. The selected products are typically delivered to the customer through an appropriate delivery port or bin (also not shown), generally accessible through the front door of the machine. The vending machine 10 contains upper and lower internal cavities or chambers 16 and 18 respectively, separated by an internal wall or divider member 17. In the embodiment illustrated the walls defining the upper chamber refrigerated cavity 16, are insulated, as well as the relevant portions of the front door assembly 14, as generally shown at 19, to maintain the refrigerated ambient air temperature of the upper chamber. Also while not illustrated in the figures, it will be understood that appropriate shelving or other product containment means are mounted within the upper internal chamber 16, as well as appropriate mechanisms for effecting the vending of items held by such shelving or other product containment means, to the customer.

The lower cavity or chamber 18 of a refrigerated vending machine is typically configured to house the refrigeration unit of the machine. In the embodiment illustrated, the refrigeration unit is generally indicated at 20. A plurality of air passage ports or ducts are provided through the divider wall member 17, providing fluid or air communication between the upper and lower chambers of the vending machine. Such air ducts will be described in more detail hereinafter. The refrigerated air inlet duct through the divider wall for the upper internal chamber 16 is generally indicated at 17*a*; and the return duct for warm air from the upper internal chamber is generally indicated at 17*b*. In a preferred configuration of the refrigerated vending machine 10 illustrated in FIG. 1, the refrigerated air passing through the inlet duct 17*a* into the upper chamber 16 is vertically distributed throughout the upper chamber 16 through multiple perforations in a cold air supply duct panel, generally indicated at 17*c*, and vertically positioned along the back portion of the upper internal chamber 16.

Figure 2:
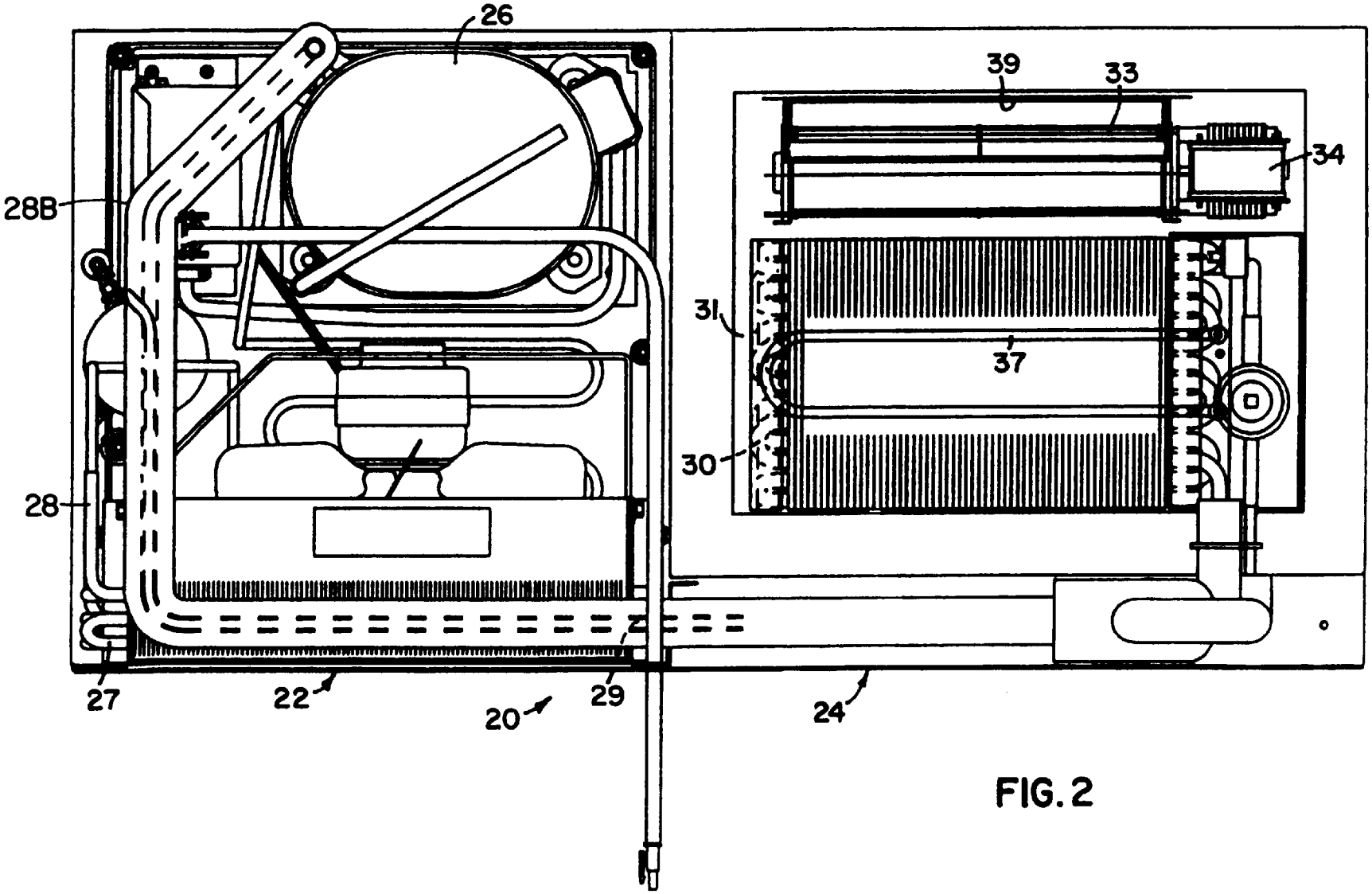
FIG. 2 is a top plan view with portions thereof removed, of the refrigeration unit portion of the vending machine disclosed in FIG. 1.
Figure 3:
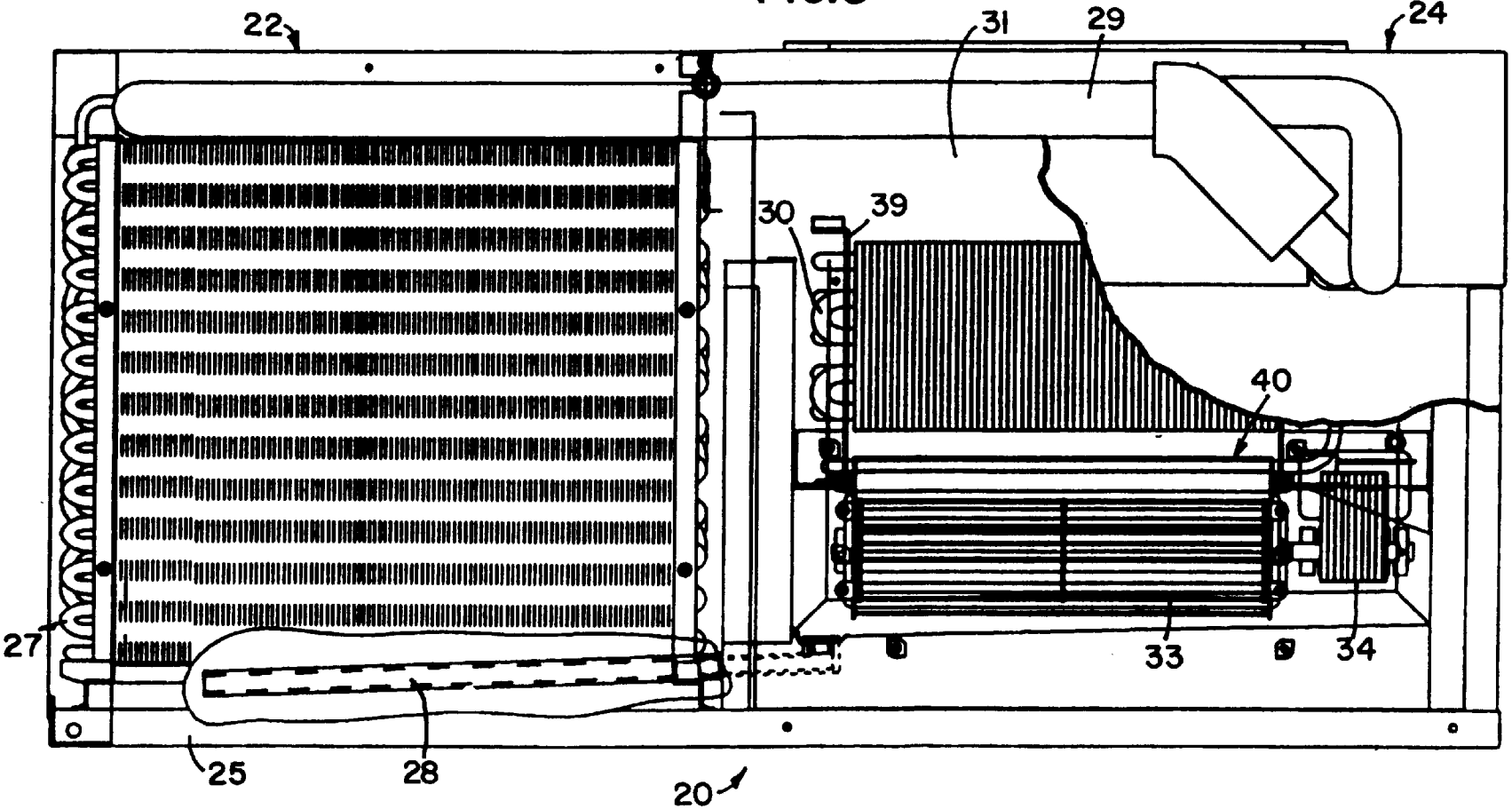
FIG. 3 is a fragmentary front elevation view of the refrigeration unit of FIG. 2 with portions thereof removed.
Figure 4:
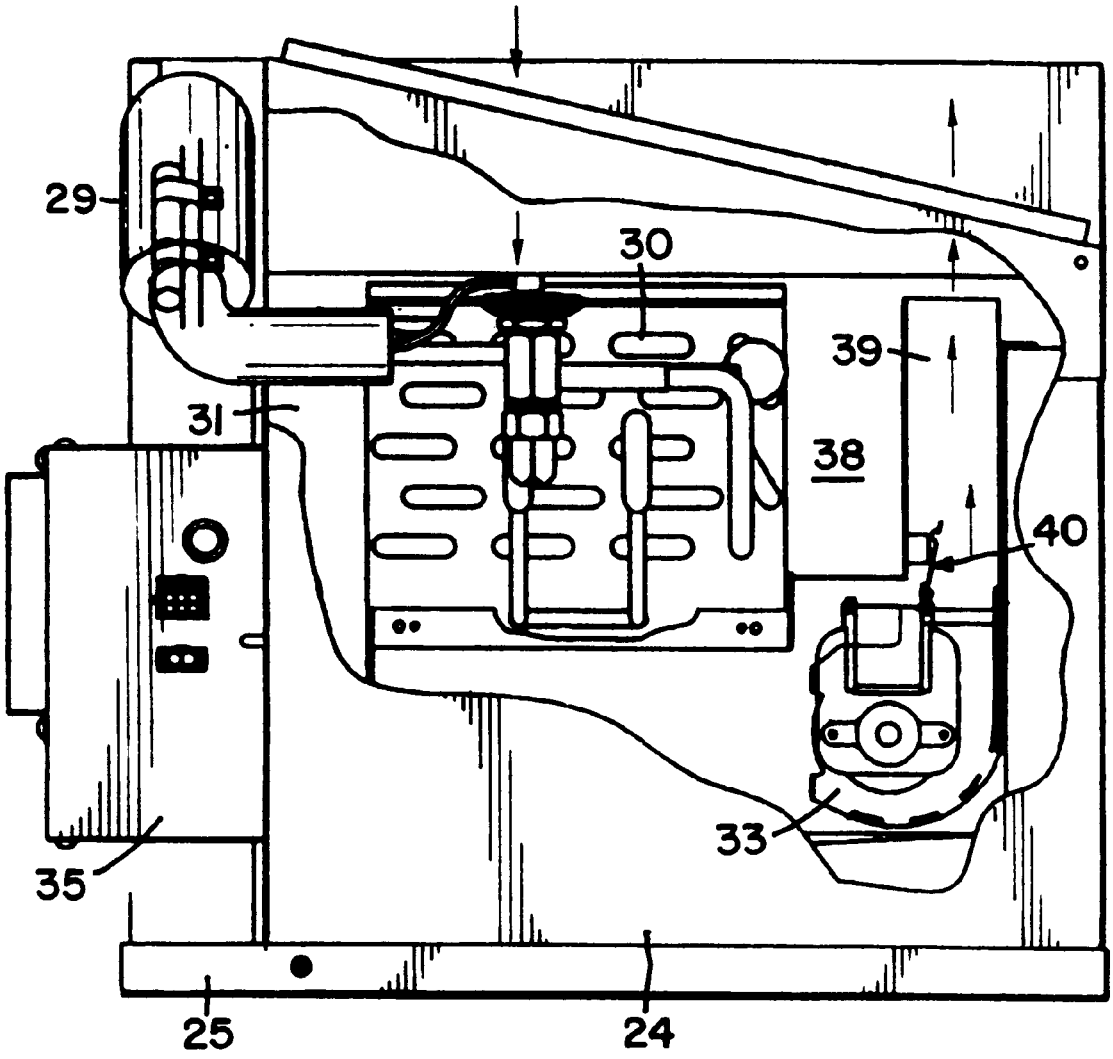
FIG. 4 is a fragmentary right side elevation view of the refrigeration unit of FIGS. 2 and 3.

The refrigeration unit 20 for a typical vending machine 10 is illustrated in more detail in FIGS. 2, 3, and 4. Referring thereto, FIG. 2 illustrates the refrigeration unit in top plan FIG. 3 illustrates the refrigeration unit in front elevation, and FIG. 4 illustrates the right side elevation of the refrigeration unit, with portions thereof broken away. Details of the refrigeration unit will not be given herein, except to the extent that portions thereof are relevant to a better understanding of this invention. As is known in the art, the purpose of the refrigeration unit 20 is to provide for and maintain cooling of the air being circulated within the refrigerated upper internal chamber 16 of the vending machine 10. It will be understood that the term refrigeration unit as used herein can refer to such units that are used to cool air in the 40° F. range as well as to units that can cool down to semifrozen levels of about 9° F. as well as to those used for frozen food applications that cool below −50° F. The refrigeration unit 20 generally includes two distinct portions comprising the condenser housing unit portion 22, illustrated at the left-hand portions of FIGS. 2 and 3, and the evaporator housing unit portion 24 illustrated at the right-hand portions of the FIGS. 2 and 3 illustrations. The condenser and evaporator housing units, while basically functionally separate, are physically mounted for common movement to a refrigeration unit frame or chassis member generally indicated at 25. The chassis 25 supports the components comprising the condenser and evaporator housing units for common movement and sliding motion on the floor 15 (FIG. 1) of the lower internal chamber 18 of the vending machine 10. The compressor members of the condenser housing 22 is generally indicated at 26, and performs the standard function of refrigeration units in compressing the refrigerant within the closed system of the refrigeration unit, thereby cooling the refrigerant in the process. The condenser housing unit portion 22 of the refrigeration unit 20 has appropriate ventilation means in the lower internal chamber 18 (not illustrated) for allowing heat generated as a result of the condensing process to be expelled to the ambient air external of the vending machine 10. The refrigeration unit 20 illustrated in FIG. 2 is depicted with the upper covers and other ducting structures removed (to be described in more detail hereinafter) from the condenser and evaporator housing units 22 and 24 respectively. The heat dissipating coils of the condenser unit are generally illustrated at 27. The refrigerant is provided to the condenser coils by means of the refrigerant inlet tubing 28 and is returned from the condenser coils 27 to the evaporator portion of the refrigeration unit by means of the insulated cooled refrigerant line 29.

The evaporator housing unit portion 24 of the refrigeration unit assembly 20 is insulated by an appropriate insulation medium such as Styrofoam or the like and generally provides for heat exchange between the evaporator coils 30 and the air being provided to and circulated within the upper chamber 16 of the vending machine. The evaporator coils 30 receive condensed refrigerant from the condenser unit 22 by means of the cooled refrigerant line 29, and provide return flow to the compressor 26 unit by means of the refrigerant return line 28B. Heat exchange between the refrigerant in the evaporator coils 30 and the surrounding air taken from the upper chamber 16 takes place within an enclosed heat exchange cavity of the evaporator unit, generally indicated at 31. For facilitating the description, the front panel portions of the condenser and evaporator housing units 22 and 24 have been removed from the FIG. 3 illustrations. The heat exchange chamber 31 forms a continuous air duct passageway between the air return duct 17*b* (FIG. 1) and the refrigerated air inlet duct 17*a* of the upper internal chamber 16 (as hereinafter described in more detail). Directed air movement through the heat exchange chamber 31 of the evaporator unit 24 is achieved by means of a fan or a blower, generally indicated at 33, which is driven by a blower motor 34. Electrical control functions for the refrigeration unit 20 and for other related functions of the vending machine are provided by circuitry housed within a control unit, generally indicated at 35, which is in the preferred embodiment, mounted to the front panel of the evaporator unit housing 24. The evaporator unit 24 also includes an appropriate defroster heating element, generally indicated at 37 which enables periodic defrosting of the evaporator coils 30, which have a tendency to collect condensation that forms ice on the evaporator coils during operation of the refrigeration unit. The heating element may, for example, be an incaloy heater or any other appropriate heating element. The general operation of such refrigeration units is well-known in the art, and will not be detailed herein. Those skilled in the art will readily appreciate and understand the general principals of operation of such refrigeration units.

The heat exchange air chamber 31 of the evaporator unit 24 is divided and/or otherwise configured to direct air flow through the evaporator unit housing in a direction as indicated by the arrows in FIG. 4, from the warm air return duct 17*b* portion of the upper chamber 16 through the heat exchange chamber 31 and to the refrigerated air inlet duct 17*a* portion of the upper chamber 16. In the preferred embodiment, as illustrated in FIG. 4, such air movement control within the heat exchange chamber 31 is accomplished by means of a chamber divider wall member generally illustrated at 38 and an outlet air duct 39. Air entering the heat exchange chamber 31 through the warm air return duct 17*b* first passes through the evaporator coil 30 portion of the evaporator unit housing 24, and is pulled by the fan or blower 33 around the chamber wall divider 38 and directed into the outlet air duct 39, toward the refrigerated air inlet duct 17*a* of the upper chamber 16. In the embodiment illustrated, a two-part self-sealing duct extension assembly completes the air transfer movement between the evaporator housing unit 24 and the upper chamber 16.

Figure 5:
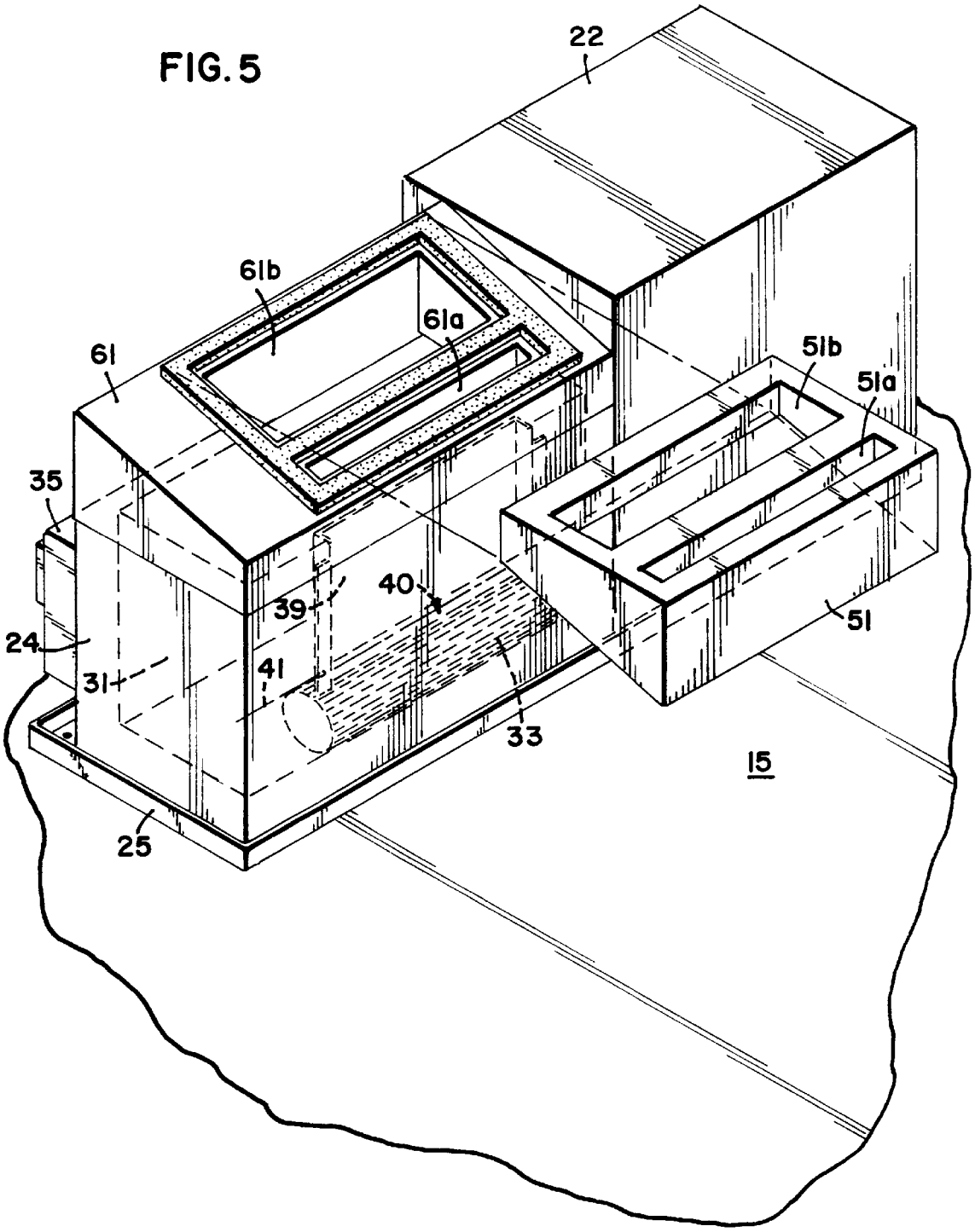
FIG. 5 is an enlarged perspective view of the refrigeration unit and associated duct assembly portions of the vending machine of FIG. 1.

The two-part self-sealing duct extension assembly 50 is illustrated in more detail in FIG. 5. Referring thereto, the duct extension assembly 50 generally includes mating upper and lower portions 51 and 61 respectively that cooperatively align with one another within the lower chamber 18 to form continuous air passageways therethrough from the upper chamber 16 to the heat exchange cavity 31 of the evaporation unit 24 (as illustrated in FIG. 1.) First passageways 51*a* and 61*a* of the upper and lower duct portions 51 and 61 respectively form a continuous passageway from inlet port 17*a* of chamber 16 to the outlet air duct 39 of the evaporation unit 24. Second passageways 51*b* and 61*b* of the upper and lower duct portions 51 and 61 respectively form a continuous passageway from the warm air return port 17*b* of the upper chamber to the heat exchange cavity 31 of the evaporator unit 24. The blower 33 moves air from the upper chamber 16, through return air port 17*b,* through passageways 51*b* and 61*b,* through the cavity 31, past the blower 33, through the air duct 39, through the air passageways 61*a* and 51*a* and finally through the refrigerated air inlet port 17*a* back into the upper chamber 16. Appropriate seal means are provided between the duct extension members 51 and 61 and between the extension members and the divider wall 17 and the evaporator unit 24 to ensure that the recited air passageways are leak proof. The duct passages as well as the evaporator unit cavity 31 are all insulated to enhance the refrigeration and defrosting cycles.

A damper member 40 is pivotally mounted for movement within the outlet air duct 39 of the evaporator unit and moves about its pivot axis 41 to selectively open or close air flow through the outlet air duct 39. An enlarged view of the damper assembly 40 is illustrated in FIG. 6. The damper is in the preferred embodiment constructed of lightweight aluminum and is easily pivoted to an "open" position as shown in FIG. 8, when the blower 33 is operating to push significant air flow through the air duct 39. However, when the blower is off and there is no forced air flow through duct 39, the damper 40 will pivot about its axis 41 to a "closed" position as shown in FIG. 7, closing the air duct 39 to airflow therethrough that may be caused by mere convection air flow currents within the duct 39. In the preferred embodiment, the damper 40 includes a pair of ribs 40*a* and 40*b* which longitudinally extend the length of the damper to add structural strength to the thin damper material. In the preferred embodiment illustrated, the pivot axis 41 of the damper runs along the rib member 40*a* as illustrated in FIGS. 6–8. The off center weight of the damper material is sufficient to maintain the damper in its "closed" position when the blower 33 is off, but offers little resistance to air currents generated by the blower when it is running, and readily pivots to its "open" position when the blower is on. A small flap member 44 is formed on one wall of the air duct 39 (see FIGS. 6–8) and engages and acts as a pivotal stop member for the damper when pivoted to its "open" position (FIG. 8). The stop member 44 prevents the damper from pivoting over center (i.e. more than 90°) so that it readily falls by a gravity back to its closed position when the blower turns off.

When a defrost cycle is initiated, the control circuitry turns off and inhibits operation of the blower 33 during the defrost cycle. This causes the damper 40 to close, preventing air flow from the heat exchange chamber 31 of the evaporator unit 24 up through the duct 39 and into the refrigerated chamber 16. The duct also prevents cold air from back flowing through the duct 39 and into the evaporator unit, that would slow the defrosting operation.

The heater 37 is energized and the heat generated thereby rises to the iced evaporator coils, defrosting term. Since the heat cannot escape into the overlying chamber 16, through the duct 39 all of the generated heat is initially used for defrosting, thereby reducing the defrosting cycle time. Further, defrosting heat will not readily escape into the refrigerated compartment through the return air passageway since the ice collected on the evaporator coils and fin structure prevents most of the heat from penetrating through the evaporation unit. Since the defrosting heat does not enter the refrigerated chamber 16, the ambient air temperature within the chamber 16 is maintained during the defrosting cycle at a safe temperature, that minimizes damage to the dispensable products. Also, as the warm air rises through the evaporator coil, it gives up its heat to the coil, thus warming the coil and shortening the defrost cycle.

Typical defrosting cycle times for refrigerated food units range from 7 to 10 minutes and are performed every 6 to 8 hours. Typical defrosting times for frozen food units may take as long as 16–20 minutes when defrosted on a 6 to 8 hour interval schedule. Tests using this invention on refrigerated food units showed a temperature rise in the refrigerated compartment during the defrosting cycle of only 3° F. from 41°, whereas prior art rises were from 20° to 30° F. Defrosting cycles for frozen food units using this invention revealed temperature rises in the frozen food compartment to only 10° F. whereas the temperature rise due to prior art techniques was in the 40° F. to 60° F. range.

A preferred range of temperature rise in chamber 16 for refrigerated food units would be in about the 41° to 51° range; whereas for frozen food units, the rise would preferably be to temperatures below 30° F. It can be appreciated that the simple damper configuration of this invention provides significant energy cost and time savings during a defrosting cycle.

Other modifications of the invention will be apparent to those skilled in the art in light of the foregoing description. This description is intended to provide specific examples of an embodiment which clearly discloses the present invention. Accordingly, the invention is not limited to the embodiments disclosed or to the use of any particular materials or specific shapes of parts presented herein. All alternative modifications and variations of the present invention which follows in the sprit and broad scope of the appended claims are included.

We claim:

1. An air flow control apparatus for use in combination with a refrigerated vending machine of the type having a refrigerated chamber for housing frozen or semi-frozen items to be dispensed, a refrigeration unit for supplying cold air, a duct operatively connecting the refrigeration unit to said refrigerated chamber and a defroster for defrosting a portion of said refrigeration unit, comprising: an air flow control valve operatively connected with said duct and responsive only to forced air flow through said duct, said valve being movable to an open position enabling air flow through said duct into said refrigerated chamber when forced air impinges on said valve in a direction toward said refrigerated chamber, and being operative to close air flow through said duct in the absence of said impinging forced air flow.

2. A method of defrosting a refrigeration unit of a refrigerated vending machine of the type having a refrigerated chamber for housing products to be dispensed, a refrigeration unit, defrosting means for the refrigeration unit, an air transfer duct for delivering refrigerated air from the refrigeration unit to the refrigerated chamber, and a damper mounted relative to said duct for selectively enabling and preventing air flow through said duct to said refrigerated chamber, comprising the steps of:

a. disabling any blowers or fans associated with an evaporator portion of the refrigeration unit during a defrosting cycle;

b. applying defrosting heat to that portion of the refrigeration unit to be defrosted;

c. causing said damper to move to a closed position without applying energy consuming activation to said damper, thereby preventing the applied defrosting heat from passing through said air transfer duct and into the refrigeration chamber, thereby minimizing rise of ambient air temperature in the refrigerated chamber during the defrosting cycle.

3. The method of claim 2, wherein the refrigerated vending machine is operatively configured to maintain ambient air temperature within the refrigerated compartment in the range of from about 37° F. to 45° F. and wherein said method further includes maintaining said ambient air temperature in the refrigerated chamber during said defrosting cycle below about 51° F.

4. The method of claim 2, wherein the refrigerated vending machine is operatively configured to maintain ambient air temperature within the refrigerated compartment below about −5° F. and wherein said method further includes maintaining said ambient air temperature in the refrigerated chamber during said defrosting cycle below about 30° F.

5. The method of claim 4, wherein said method further includes maintaining said ambient air temperature in the refrigerated chamber during said defrosting cycle below 15° F.

6. An air flow control apparatus for use in combination with a refrigerated vending machine of the type having a refrigerated chamber for housing refrigerated items to be dispensed, a refrigeration unit for supplying cold air, a duct operatively connecting the refrigeration unit to said refrigerated chamber and a defroster for defrosting a portion of said refrigeration unit, comprising: a damper of lightweight material operatively pivotally mounted in said duct and responsive to forced air currents therethrough generated by a blower or fan of said refrigeration unit; said damper selectively controlling air flow through said duct during a defrosting operation and being movable to substantially close said duct for air flow therethrough when said defroster is defrosting and to enable air flow through said duct when said defroster is not defrosting.

7. The apparatus of claim 6, wherein said damper is mounted to control air flow through a refrigerated air outlet duct of the refrigeration unit.

8. A vending machine apparatus comprising:

a. a chassis defining a refrigerated chamber for housing items to be dispensed, and a second chamber separated from said refrigerated chamber by a divider wall;

b. an air duct connecting said refrigerated and said second chambers;

c. a refrigeration unit operatively connected to said air duct to supply refrigerated air to said refrigerated chamber;

d. a defroster operatively connected with said refrigeration unit to periodically defrost said refrigeration unit; and e. an air flow valve operatively connected with said air duct and movable between open and closed positions, the movement of said valve being responsive to forced air flow within said duct to selectively enable or close air flow through said duct respectively when in said open and closed positions; whereby said valve is closed when said defroster is defrosting.

9. The vending machine of claim 8, wherein said air flow valve comprises a damper.

10. The apparatus of claim 8, wherein said air duct passes through said divider wall.

11. The apparatus of claim 8, wherein said valve is configured to pivotally move about a pivot axis between said open and closed positions, wherein said valve is eccentrically disposed relative to said pivot axis and is arranged and configured within said air duct such that said valve moves by forces of gravity to said closed position when said forced air flow is not present within said duct.

12. The apparatus of claim 8, wherein said valve is mounted in said duct such that when in said closed position it operates to block heated air generated by said defroster from passing through said duct and into said refrigerated chamber.

13. The apparatus of claim 8, wherein said valve operatively moves only in response to said forced air flow impinging on said valve and does not require dedicated control functions for the valve that require power for operation.

* * * * *

UNITED STATES PATENT AND TRADEMARK OFFICE

CERTIFICATE OF CORRECTION

PATENT NO. : 5,899,079

DATED : MAY 4, 1999

INVENTOR(S) : DUNNIGAN ET AL.

It is certified that error appears in the above-identified patent and that said Letters Patent is hereby corrected as shown below:

Col. 4, line 29: " −50° " should read — −5° —

Col. 4, line 42: "members" should read —member—

Signed and Sealed this

Eleventh Day of January, 2000

*Attest:*

*Attesting Officer*

Q. TODD DICKINSON

*Acting Commissioner of Patents and Trademarks*